US006559768B2

(12) United States Patent
Schaffner et al.

(10) Patent No.: US 6,559,768 B2
(45) Date of Patent: May 6, 2003

(54) MOMENT OF IMPULSE ANTI-SMOKING MESSAGE SYSTEM

(76) Inventors: Daniel K. Schaffner, 839-B Keene Rd. North, Clearwater, FL (US) 33755; Bradley Doyt Schaffner, 839-B Keene Rd. North, Clearwater, FL (US) 33755

( * ) Notice: Subject to any disclaimer, the term of this patent is extended or adjusted under 35 U.S.C. 154(b) by 0 days.

(21) Appl. No.: 09/682,118

(22) Filed: Jul. 24, 2001

(65) Prior Publication Data

US 2003/0020614 A1 Jan. 30, 2003

(51) Int. Cl.[7] ..... G08B 23/00
(52) U.S. Cl. ..... 340/573.1; 340/545.6
(58) Field of Search ..... 340/573.1, 571, 340/572.8, 555, 593, 5.28, 5.32, 583, 644, 545.3, 545.6; 131/270, 329

(56) References Cited

U.S. PATENT DOCUMENTS 3,655,325 A * 4/1972 Toppel ..... 274/14
4,620,555 A * 11/1986 Schwarz ..... 131/270
5,864,289 A * 1/1999 Tiemann ..... 340/568.7
5,992,629 A * 11/1999 Gullord et al. ..... 206/459.1
6,116,977 A * 9/2000 Tanny et al. ..... 446/8
6,170,662 B1 * 1/2001 Howes ..... 206/459.1
6,298,990 B1 * 10/2001 Amrod et al. ..... 206/459.1

* cited by examiner

*Primary Examiner*—Van Trieu
*Assistant Examiner*—Son Tang
(74) *Attorney, Agent, or Firm*—Ronald E. Smith; Smith & Hopen, P.A.

(57) ABSTRACT

An anti-smoking system is built into a lidded container that holds cigarette packs. When the lid of the container is opened to grant access to the cigarette pack, an audible anti-smoking message is generated and played by an electrical circuit. Plural messages of differing content are provided so that the same message is not heard twice in a row. In a first embodiment, the circuit is activated in response to a signal from a light-sensitive device positioned within the lid so that the act of opening the container in an illuminated environment triggers the message. In a second embodiment, a normally open switch in the electrical circuit is closed when the lid is removed from the container. This activates the circuit independently of lighting conditions. In both embodiments, the system delivers an anti-smoking message at the moment of impulse, maximizing the psychological impact of the message.

12 Claims, 2 Drawing Sheets

MOMENT OF IMPULSE ANTI-SMOKING MESSAGE SYSTEM

BACKGROUND OF INVENTION

1. Field of the Invention

This invention relates, generally, to methods and devices that help people stop smoking cigarettes. More particularly, it relates to a system that delivers an audible anti-smoking message at the moment of impulse.

2. Description of the Prior Art

U.S. Pat. No. 5,228,848 to Kim discloses a cigarette lighter having an anti-smoking message stored on an analog storage chip capable of emitting a short verbal message. Only one message is provided, but means are included that enables the erasing of the message and the recording of a new message when desired.

There are two drawbacks to the Kim approach. First of all, the cigarette lighter has a complex structure and is therefore not an inexpensive, disposable item. More importantly, the anti-smoking message is not delivered at the critical moment the moment of impulse. By the time the smoker activates the lighter and hears the message exorting him or her to refrain from smoking, the cigarette has already been placed between the lips and the decision to smoke has been made.

What is needed, then, is a system for sequentially delivering multiple anti-smoking messages, one at a time, so that the user does not become jaded by hearing the same message and thus does not stop listening to it.

A need also exists for a system that delivers an anti-smoking message at the moment of greatest psychological impact the moment before a fully committed decision to smoke has been made, i.e., before a cigarette has been retrieved from a pack and placed between the lips.

However, in view of the prior art considered as a whole at the time the present invention was made, it was not obvious to those of ordinary skill in the pertinent art how the identified needs could be fulfilled.

SUMMARY OF INVENTION

The longstanding but heretofore unfulfilled need for an anti-smoking device that delivers anti-smoking messages at the moment of impulse to smoke is now met by a new, useful, and nonobvious invention. The invention is an anti-smoking system that includes a housing for holding a package of cigarettes. The housing includes a container and a closure means for selectively opening and closing the container. An audio module includes an electrical circuit for generating audible messages and is positioned within a space defined by the lid. The electrical circuit includes a battery means and a voice synthesizer means disposed in electrical communication with the battery means. A normally open switch means is disposed in switching relation between the battery means and the voice synthesizer means. The electrical circuit further includes a speaker means connected in driven relation to the voice synthesizer means.

In a first embodiment, a light-responsive means adapted to generate an electrical signal in response to detection of light is connected in controlling relation to the switch means so that when the light-responsive means detects the presence of light, the light-responsive means generates an electrical signal that activates the switch means. In this way, the novel system plays an audible anti-smoking message when the closure means is at least partially opened in the presence of ambient light.

In a second embodiment, a normally open switch is closed when the closure means is wholly or at least partially opened. More particularly, a normally open switch is held open for as long as the closure means makes physical contact with the container that holds the cigarette pack. When the normally open switch is closed, it connects the battery to the active components of the electrical circuit and the anti-smoking voice message is activated. The second embodiment, therefore, does not rely upon the presence of ambient light and is fully functional in a light or dark environment.

Nor is the invention limited to the use of a normally open switch means. A circuit designer of ordinary skill could easily change the expressly disclosed electrical circuit to include a normally closed switch means in lieu of the normally open switch means. Any other mechanical or electrical means that activates the electrical circuit upon removal or at least partial removal of the closure means from the container is within the scope of this invention. Moreover, the invention is not limited to either of the electrical circuits disclosed herein because it is within the ordinary skill of a circuit designer to re-design such circuits and to accomplish the inventive work while employing a different yet equivalent electrical circuit. Accordingly, all such equivalent electrical circuits are within the scope of this invention.

In all embodiments, the anti-smoking message is delivered at the moment of impulse to smoke, even before a fully committed decision to smoke has been made. The message is therefore delivered with maximum psychological impact. More specifically, it is delivered even before the smoker can touch a cigarette. This gives the smoker a moment to reflect upon his or her actions and to close the container before a cigarette is withdrawn from the cigarette pack and placed between the lips.

In the first embodiment, the container and the closure means are substantially light-tight when the container is fully closed by the closure means.

In the second embodiment, the container and closure means are in electrical contact with one another when the closure means is fully seated with respect to the container.

In either embodiment, the closure means may be detachably connected to the container or hingedly attached thereto.

The system further includes a memory means having sufficient capacity to hold sufficient data to generate a plurality of anti-smoking messages. The messages are stored in a queue and played sequentially so that no two successive messages are the same.

The voice synthesizer means is preferably a digital voice synthesizer means.

A preferred embodiment of the electronic means contained within the novel audio module includes a battery means, a photocell in electrical communication with the battery means, a normally open switch means in series with the photocell, a driver in series with the switch means, a digital voice synthesizer means including a read only memory means electrically connected to an output of the driver means, a digital-to-analog converter electrically connected to an output of the digital voice synthesizer means, an amplifier means electrically connected to an output of the digital-to-analog converter, and a speaker means electrically connected to an output of the amplifier means.

A second embodiment of the electronic means contained within the novel audio module includes a battery means, a normally open switch means in series with the battery, a driver in series with the switch means, a digital voice synthesizer means including a read only memory means electrically connected to an output of the driver means, a digital-to-analog converter electrically connected to an output of the digital voice synthesizer means, an amplifier means electrically connected to an output of the digital-to-analog converter, and a speaker means electrically connected to an output of the amplifier means. A protrusion formed in the closure means holds the normally open switch means open when the closure means is seated on the container. The normally open switch means is biased to close so that the switch means closes when the closure means is removed or at least partially removed from the container.

A primary object of the invention is to provide an anti-smoking system that has a maximum psychological impact on a smoker using the system.

A more specific object is to provide an anti-smoking message to a smoker at the moment the smoker has an impulse to have a cigarette, even before a fully committed decision to smoke has been made.

Another object is to provide an anti-smoking system that sequentially plays digitally-generated anti-smoking messages of varying content so that the smoker does not hear the same message every time an impulse to smoke is felt.

Yet another object is to provide a system that forms a part of a container for cigarette packs so that the system is activated upon opening of such container.

Still another object is to provide a system that delivers an anti-smoking message before a cigarette can be retrieved from a cigarette pack housed in the novel container.

Another object is to attain the foregoing objects with an inexpensive, disposable system.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which.

DETAILED DESCRIPTION

Figure 1A:
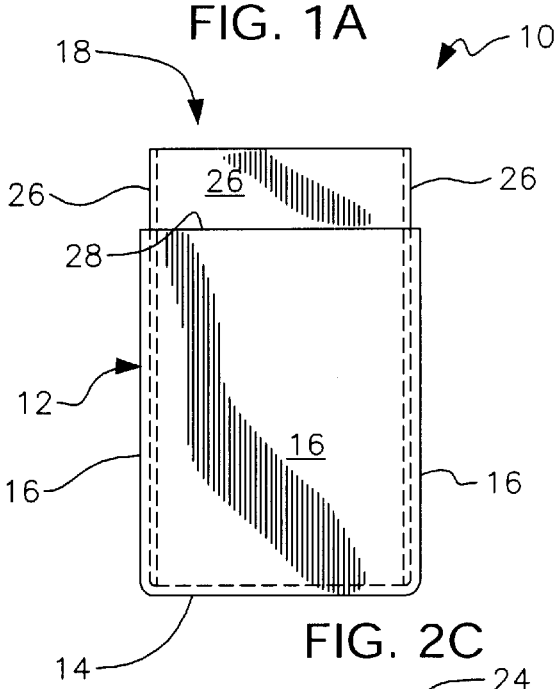
FIG. 1A is a front elevational view of a cigarette container.
Figure 1B:
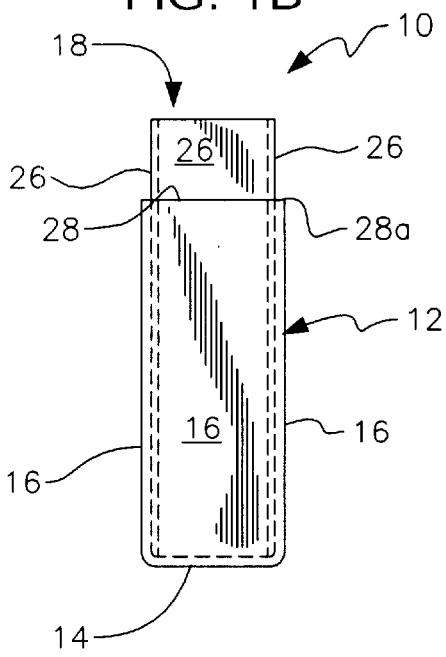
FIG. 1B is a side elevational view thereof.

Referring to FIGS. 1A and 1B, it will there be seen that the reference numeral 10 denotes an illustrative embodiment of the present invention.

Anti-smoking system 10 is provided in the form of a cigarette case or container and closure means of conventional size and shape. As such, it is a familiar object to smokers so that it is likely to be used as a matter of course.

The system includes a container 12 for housing a pack of cigarettes. It has a standard construction including flat bottom wall 14 and a plurality of upstanding sidewalls, collectively denoted 16, mounted about the periphery of said bottom wall and projecting upwardly therefrom to form a cigarette pack-holding space 18 therebetween.

Figure 2C:
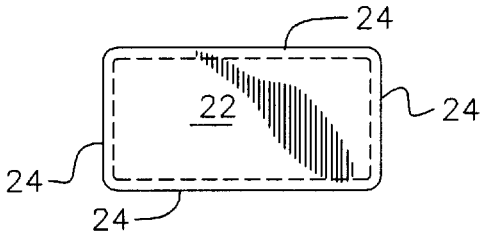
FIG. 2C is a top plan view thereof.
Figure 2A:
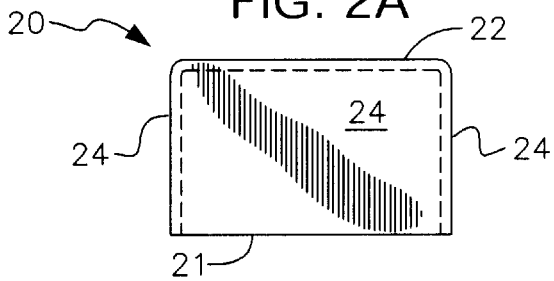
FIG. 2A is a front elevational view of a closure means for said container.
Figure 2B:
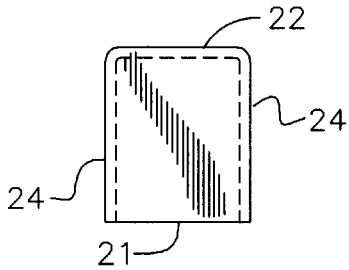
FIG. 2B is an end elevational view thereof.

As depicted in FIGS. 2A, 2B, and 2C, closure means or lid 20 has a similar construction, including flat top wall 22 and a plurality of upstanding sidewalls, collectively denoted 24, mounted about the periphery thereof and depending therefrom.

Lid 20 may be secured to container 12 by a hinge means, not shown, or by any other well-known means for connecting a lid to a base such as container 12. In this particular embodiment, a plurality of mounting walls, collectively denoted 26 in FIGS. 1A and 1B, are formed integrally with upstanding sidewalls 16, but are offset slightly inwardly therefrom to form a shoulder 28. Mounting walls 26 are thus press fit into the hollow interior of lid 20 when said lid is secured to container 12, and the lowermost peripheral edge 21 of lid 20 (FIGS. 2A and 2B) abuts shoulder 28. In this way, lid 20 is flush with container 12 when lid 20 is in closing relation to said container, as perhaps best understood in connection with FIG. 3. It should be understood, however, that the mechanical means for securing lid 20 to container 12 is not a part of this invention, per se, and all means for interconnecting said lid and container, such as a hinged connection, not shown, are within the scope of this invention.

Figure 3:
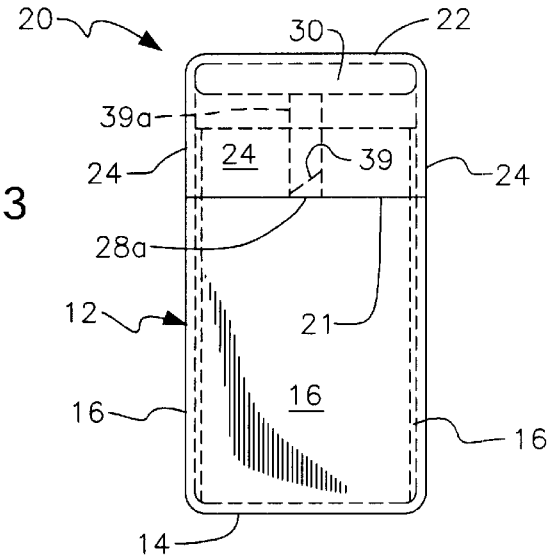
FIG. 3 is a front elevational view of the novel container and closure means when in their fully assembled configuration.
Figure 4A:
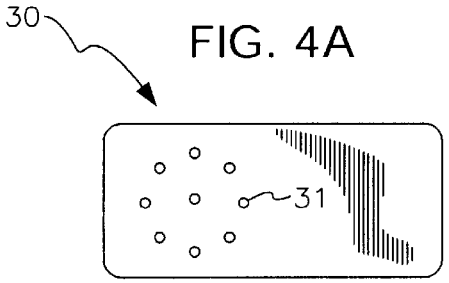
FIG. 4A is a bottom plan view of the novel audio module.
Figure 4B:
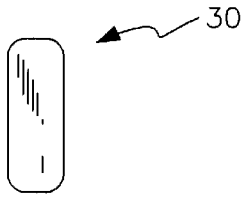
FIG. 4B is an end view thereof.

Lid 20 also serves as a housing for audio module 30 depicted in FIGS. 3, 4A and 4B of this invention. Openings 31 formed in audio module 30 enable sound to escape therefrom. FIG. 4A is a bottom plan view so it should be understood that openings 31 are oriented downwardly in the view of FIG. 3 so that the audio message is not muffled.

Figure 5:
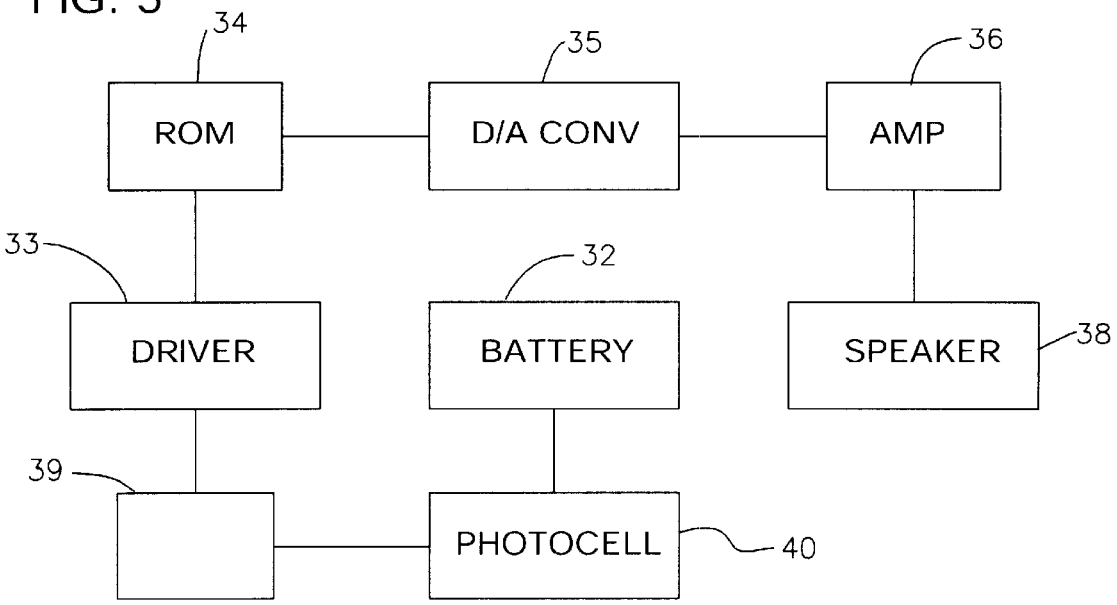
FIG. 5 is an electrical schematic diagram of an electrical circuit housed within the audio module of a first embodiment of the invention.

As indicated in FIG. 5, the electrical schematic for a first embodiment of the electrical circuit housed within audio module 30 includes a battery means 32, a driver 33, a digital voice synthesizer means including a read only memory 34 in electrical communication with said battery means, a digital-to-analog converter 35, an amplifier means 36, a speaker means 38 and a light-responsive signal generator means which may take the form of photocell 40. Normally open switch means 39 is positioned between photocell 40 and driver 33.

Signal generator means 40 is positioned within lid 20 so that when said lid 20 is removed from housing 12, or hingedly separated therefrom, ambient light enters into the interior of lid 20 and impinges upon signal generator means 40. Upon detecting the presence of light, signal generator means 40 generates a signal that closes switch means 39 and a message such as "Smoking causes heart disease" is played by speaker means 38 and heard by the person who opened the container.

A plurality of such messages is stored in the digital memory of the voice synthesizer means 34 in a queue so that a different message is heard when the lid is removed a second time and so that several different messages are heard before the messages begin repeating themselves.

Light-sensitive signal generator means 40 is highly sensitive so that an anti-smoking message is heard even if the cigarette case is just partially opened in a low ambient light environment such as a bar.

Figure 6:
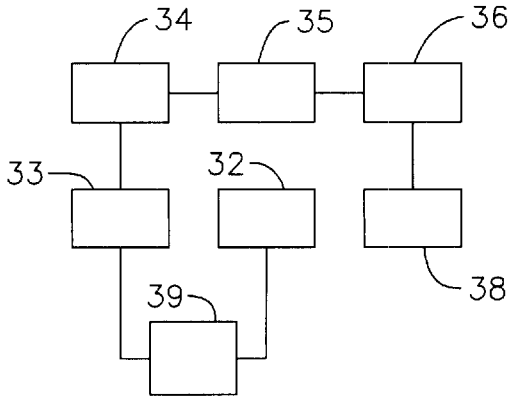
FIG. 6 is an electrical schematic diagram of an electrical circuit housed within the audio module of a second embodiment of the invention.

No photocell is required in a second embodiment of the invention. As depicted in FIG. 6, the electrical circuit of this second embodiment includes includes battery means 32, driver 33, digital voice synthesizer means including read only memory 34 in electrical communication with said battery means, digital-to-analog converter 35, amplifier means 36, speaker means 38 and normally open switch means 39 positioned between battery means 32 and driver 33.

As depicted in FIGS. 1B and 3, a protrusion 28*a* is formed in shoulder 28 of container 12 at any preselected point along the extent thereof. Protrusion 28*a* holds switch means 39 open when closure means 20 is seated against container 12. Switch means 39 is biased to close so that separation of closure means 20 from container 12 allows switch means 39 to close and to complete the circuit, thereby causing generation and playing of an anti-smoking message.

In this particular embodiment, switch means 39 is not housed within audio module 30 but is disposed externally thereof as depicted in FIG. 3. Electrical conductors 39*a* (FIG. 3) join switch means 39 to the other elements of the electrical circuit housed within audio module 30.

Machine and circuit designers will recognize that there are numerous other ways to activate the electrical circuit housed within audio module 30 upon separation or at least partial separation of closure means 20 from container 12. All of such alternative ways are within the scope of this invention because all of them have become obvious in view of the disclosure made herein.

Repeatedly hearing even a mild an anti-smoking message such as "Let's wait 15 minutes before we have another smoke" has a profound psychological effect on the smoker if delivered at the moment of impulse to smoke. Almost every smoker wants to quit and is willing to try various anti-smoking systems. Accordingly, the novel device will be eagerly sought after by virtually every smoker, and it will be appreciated and used even if given to a smoker as a gift.

By delivering its thought-provoking message before a cigarette is held between the lips, the system provides a maximum anti-smoking psychological impact.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described.

What is claimed is:

1. An anti-smoking system, comprising:

a housing for holding a package of cigarettes;

said housing including a container and a closure means for selectively opening and closing said container;

an audio module positioned within said closure means;

said audio module containing an electrical circuit for generating audible messages;

said electrical circuit including a battery means;

said electrical circuit including a voice synthesizer means in electrical communication with said battery means;

a switch means disposed in electrical communication with said battery means and said voice synthesizer means;

said electrical circuit including a speaker means connected to an output of said voice synthesizer means;

a light-responsive means adapted to generate an electrical signal in response to detection of light;

said light-responsive means connected in controlling relation to said switch means;

said light-responsive means adapted to generate an electrical signal that activates said switch means when said light-responsive means detects the presence of light;

said voice-synthesizing means generating an audible anti-smoking message that is played over said speaker means when said closure means is at least partially removed from said container in the presence of ambient light; and said anti-smoking message being delivered for maximum psychological impact at the moment of impulse to smoke.

2. The system of claim 1, wherein said container and said closure means are substantially light-tight when said container is fully closed by said closure means.

3. The system of claim 1, wherein said voice synthesizer means includes a memory means having a predetermined capacity to hold sufficient data to generate a plurality of anti-smoking messages.

4. The system of claim 3, wherein said memory means contains a plurality of different messages in a queue that are played one at a time in sequence.

5. The system of claim 1, wherein said voice synthesizer means is a digital voice synthesizer means.

6. The system of claim 3, wherein said memory means is a read only memory.

7. The system of claim 1, wherein said closure means is detachably secured to said container.

8. The system of claim 1, wherein said closure means is hingedly secured to said container.

9. The system of claim 1, wherein said switch means is normally open.

10. The system of claim 1, further comprising:

a driver means disposed in driving relation to said voice synthesizer means, said driver means being in electrical communication with said battery means.

11. The system of claim 10, further comprising:

a digital-to-analog converter in electrical communication with an output of said voice synthesizer means.

12. The system of claim 10, further comprising:

an amplifier means disposed in electrical communication with an output of said digital-to-analog converter.

* * * * *